United States Patent [19]

Ryan

[11] 4,241,962

[45] Dec. 30, 1980

[54] STORAGE APPARATUS FOR RECORDS AND THE LIKE

[75] Inventor: Keith Ryan, Harrow, England

[73] Assignee: Recordex Limited, Tortola, British Virgin Isls.

[21] Appl. No.: 943,383

[22] Filed: Sep. 13, 1978

[30] Foreign Application Priority Data

Sep. 16, 1977 [GB] United Kingdom ..... 38737/77

[51] Int. Cl.[3] ..... A47B 63/00; A47F 5/12

[52] U.S. Cl. ..... 312/183; 312/185; 312/192; 312/233; 211/170; 248/447

[58] Field of Search ..... 312/183, 185, 187, 192, 312/233; 211/116, 170, 46, 47; 248/447

[56] References Cited

U.S. PATENT DOCUMENTS

| | | | |
|---|---|---|---|
| 351,300 | 10/1886 | Waterman | 211/170 |
| 805,085 | 11/1905 | Meier et al. | 211/46 |
| 1,440,656 | 1/1923 | Booth | 248/447 |
| 1,862,562 | 6/1932 | Aldeen et al. | 248/447 |
| 1,910,207 | 5/1933 | Freeman | 312/233 |
| 2,019,581 | 11/1935 | Probst | 248/447 |
| 2,501,608 | 3/1950 | Lyons | 312/233 |
| 2,794,697 | 6/1957 | Bergman | 312/233 |
| 3,229,695 | 1/1966 | Kaufmann | 312/183 |
| 3,913,995 | 10/1975 | Malcik et al. | 312/183 |

FOREIGN PATENT DOCUMENTS

| | | | |
|---|---|---|---|
| 1296739 | 4/1902 | France | 312/185 |
| 513307 | 12/1937 | United Kingdom | 312/233 |

*Primary Examiner*—Victor N. Sakran
*Attorney, Agent, or Firm*—Brisebois & Kruger

[57] ABSTRACT

The invention relates to apparatus for the storage of visible index records and the like, assembled in panels, trays, and the like. The panels are stored side-by-side, suspended vertically below a plurality of horizontal panel-carriers which are arranged side-by-side and are independently pivotable at their mid-points about a common horizontal axis. Each panel is attached to its panel-carrier for swinging movement in a direction at right angles to said common axis so that by pivotting a panel-carrier through 180° to an inverted position the panel or panels attached thereto may be swung to a substantially horizontal position to provide access to the records or the like.

9 Claims, 6 Drawing Figures

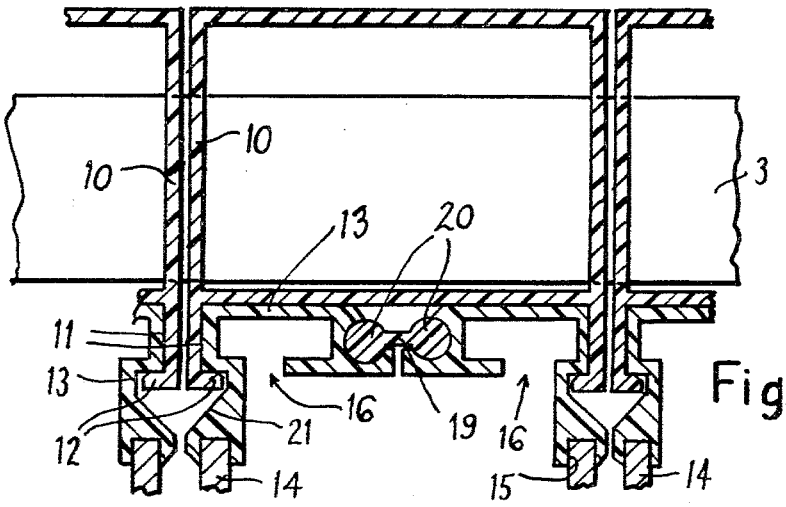
Fig.2
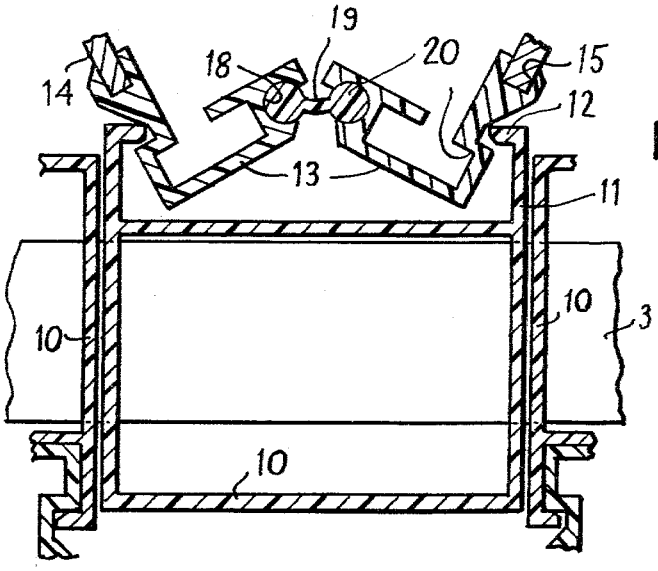
Fig.3
Fig.4
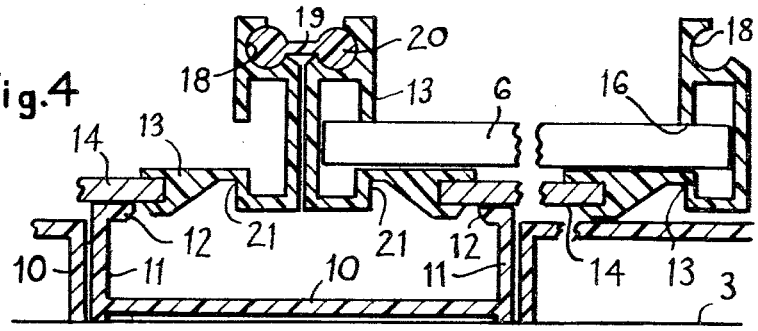

STORAGE APPARATUS FOR RECORDS AND THE LIKE

FIELD OF THE INVENTION

The present invention relates to apparatus for the storage of a plurality of panels, trays, frames and the like (hereinafter generically referred to as "panels") each of which can removably hold a plurality of papers, cards or strips (which may be arranged in overlapping array to form a visible index), microfilms, photographs or other devices (hereinafter generically referred to as "records").

For example, in the case of a visible index, record cards are normally arranged in overlapping array in a shallow tray. The record cards may be mounted on record carriers from which they may be detached for the purpose of making entries thereon or for rearrangement of the records in the tray. Where a large number of trays are required, these are often arranged as drawers in a storage stack from which the respective trays may be completely withdrawn or, alternatively, in some cases, a tray which is pulled out can be swung downwards to an inclined position with its outer end resting on a lower tray which has been pulled out from the stack. When entries or changes are made with a tray supported in this inclined position, it will be appreciated that the higher trays in the stack will be at an elevated position relative to lower trays when making entries.

Such storage systems require a space of more than twice the length of a tray to enable a tray to be extracted or to be attended to without complete withdrawal.

SUMMARY OF THE INVENTION

The present invention has for its object to provide an apparatus for the storage of a plurality of generally rectangular panels to each of which a plurality of records are removably assembled, which can achieve valuable space saving advantages and provide easy, horizontal and well-supported exposure of and access to each panel at a common convenient working height.

The invention consists in apparatus for the storage of a plurality of generally rectangular panels to each of which a plurality of records are removably assembled, which is characterised by a plurality of panel-carriers which are arranged side-by-side and independently pivotable about a common horizontal axis and to each of which is attached at least one panel for swinging movement relative to its panel-carrier in a direction at right angles to the direction in which the panel-carriers pivot about said common axis, said common axis being disposed approximately mid-way along the length of the side of the panel which is attached to the panel-carrier, whereby the plurality of panels can be stored side-by-side suspended vertically below the panel-carriers to which they are respectively attached and, by pivotting a panel-carrier through 180° to an inverted position, the panel or panels attached thereto may be swung to a substantially horizontal position to provide access to the records assembled thereto.

Preferably each panel is attached to its associated panel-carrier in such a manner that it becomes detached or is detachable therefrom when it is swung into its said substantially horizontal position.

Where a panel-carrier has a pair of panels attached thereto, the pair of panels may be independently hinged together along their respective sides which are attached to the panel-carriers.

BRIEF DESCRIPTION OF THE DRAWINGS

FIG. 2 is a section through a part of the apparatus of FIG. 1 comprising panel-carriers and the adjacent portions of panels suspended vertically therebelow, FIG. 3 is a section similar to that of FIG. 2 but with a panel-carrier inverted and the associated panels being hinged apart, FIG. 4 is a section similar to FIG. 3 but with the panels fully opened-out to their horizontal positions.

Referring to FIGS. 1 to 4 of the drawings, the embodiment shown comprises a support or stand comprising legs 1 which are connected together by a low bar 2 and by a spindle 3 which extends between the upper ends of the legs and on which a plurality of panel-carriers 4 are pivotally mounted at approximately mid-way along their length for swivelling movement about a common horizontal axis defined by the spindle 3. Suspended from each panel-carrier 4 are two panels 5 in the form of trays adapted to receive removable records 6 which, in the embodiment shown, constitute a visible index and may comprise record cards or sheets assembled in overlapping array and detachably attached to record carriers as described in the Specification of copending application Ser. No. 941,866. The panel-carriers 4 are arranged side-by-side and independently pivotable about the spindle 3. Each of the pair of panels 5 is attached to the associated panel-carrier for swinging movement in a direction at right angles to the direction in which the panel-carriers 4 pivot about the spindle 3. When the records 6 contained in a particular panel are to be inspected or changed, the panel-carrier supporting the relevant panel 5 is swung through 180° about the spindle 3 to an inverted position in which the pair of panels may be hinged apart, as indicated by the panels 5*a* in FIG. 1, to rest substantially horizontally on the upper surfaces of the other panel-carriers, in which position the records assembled to the panels are readily accessible.

Figure 1:
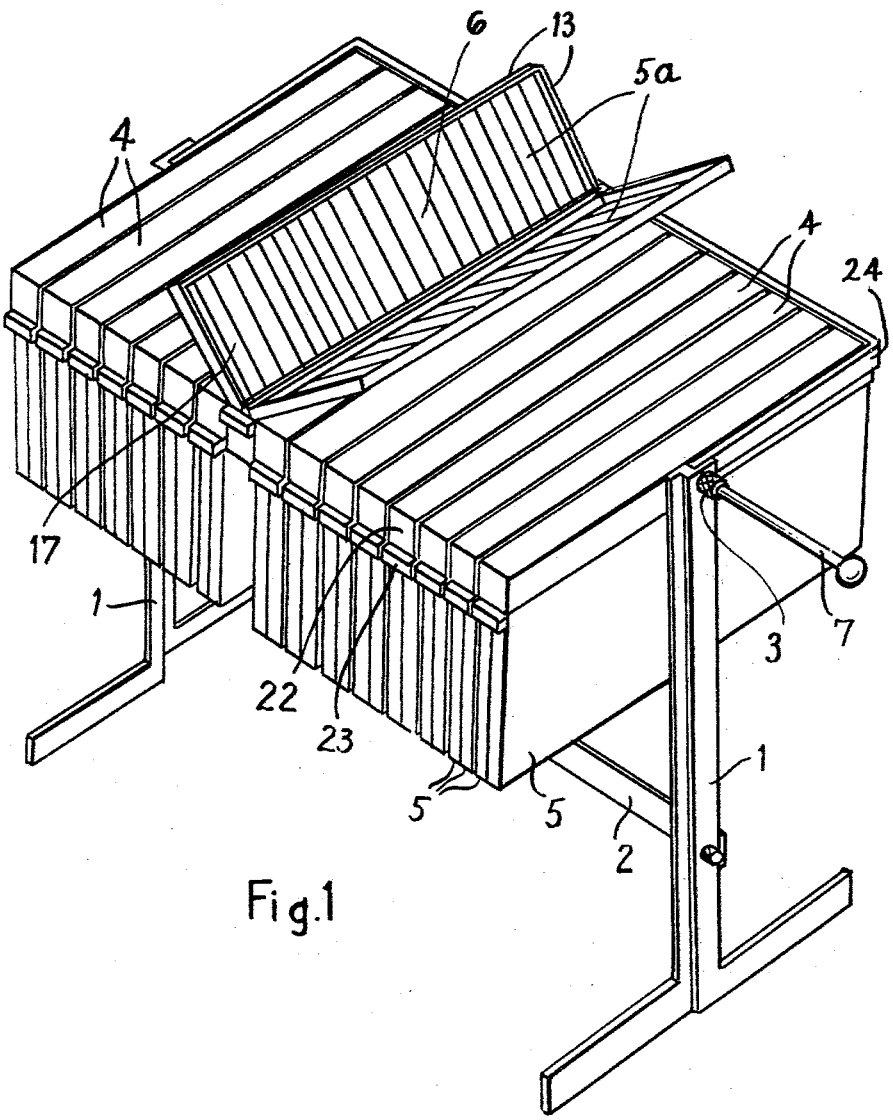
FIG. 1 is a perspective view of one embodiment of a storage apparatus according to the invention.

Preferably, each panel is attached to its associated panel-carrier in such a manner that it becomes detached or is detachable therefrom when it is swung to its said substantially horizontal position. One embodiment for achieving this is shown in FIGS. 2 to 4. The panel-carriers 4 comprise plastics extrusions having a box-like portion 10, through apertures in the side walls of which the spindle 3 extends, and extensions 11 of the side walls defining an open channel with inwardly extending ribs or abutments 12 along their free edges.

Each panel is conveniently made of a plastics extrusion 13 having the cross-section shown which is assembled along two sides and one or both ends of a base 14 made of board, card, plastics or other suitable material and secured, conveniently by adhesive, in a channel 15 in the extruded section 13. The extruded section 13 is shaped to provide, in the opposing side walls of the tray, channels 16 in which the opposite ends of the records (or record carriers) 6 are slidably received. A follower 17, conveniently of plastics material and preferably having a portion which slides in the channels 16, is provided to hold the records or record carriers in position. The follower may be lockable in the desired position, or it may have an end wall which limits the extent to which it may be inserted into the channels 16 and be provided with means for holding the follower in the inserted position.

The extruded section is also formed with a concave or part-cylindrical recess 18 extending therealong so that adjacent trays can be hingedly connected together by a strip-like connector 19, conveniently a plastics extrusion, with the cross-section shown including cylindrical or bulbous enlargements 20 along each edge which are slidably engaged in the recesses 18 of adjacent trays respectively. The openings along the length of the recesses are sufficiently wide to provide the hinge movement to permit adjacent trays to be closed together (FIG. 2) or to lie substantially in the same plane (FIG. 4). Stops may be provided for limiting lengthwise movement of the connector 19 in the recesses 18.

The extruded section 13 is also formed with a recess 21 so that, when a pair of trays are closed together, their respective recesses 21 interengage with the fulcra defined by the ribs 12 respectively, as shown in FIG. 2, so that the pair of panels will be suspended below the panel-carrier.

When a panel-carrier is turned through 180° so that the trays extend upwardly, the trays may be hinged apart as shown in FIGS. 3 and 4, which operation causes the fulcra 12 to become disengaged from the recesses 21 whereby the trays are detached from the associated panel-carrier (see FIG. 4).

To attach the pair of trays to a panel-carrier, the reverse operation is performed. The trays are positioned above the fulcra, as shown in FIG. 4, and hinged upwardly to close them together, which operation causes the recesses 21 to engage the fulcra 12 so that, when turned to the storage position, the trays will be suspended from the associated panel-carrier.

It will be understood that in hinging the trays from the position shown in FIG. 2 to the position shown in FIG. 3, there is initially an increase in the spacing between the recesses 21 due to the over-centre action of the hinge 18-19-18, so that the opening and closing operations require a resilient springing apart of the fulcra 12, and/or a resilient springing of the connector 19 and/or the extruded section 13. The over-centre reaction on the hinge helps to hold a pair of trays closed together when suspended from a panel-carrier, although the trays may be additionally or alternatively be secured together by a suitable clip, for example, by a length of the connector extrusion 19 being inserted in the recesses 18 along the free sides of the trays.

The open ends of the extrusions constituting the panel-carriers 4 may be provided with closures 22 which may, if desired, include projections or stops 23 which are adapted to engage a stirrup 24 from above to limit the inverted position of a panel-carrier. The stirrup is supported from the legs 1 and extends along and adjacent to the array of panel-carriers 4 as shown in FIG. 1. If desired, projections 23 may be provided at both ends of the panel-carriers for maintaining the panel-carriers substantially horizontal when in either of their storage or record-access positions.

Figure 5:
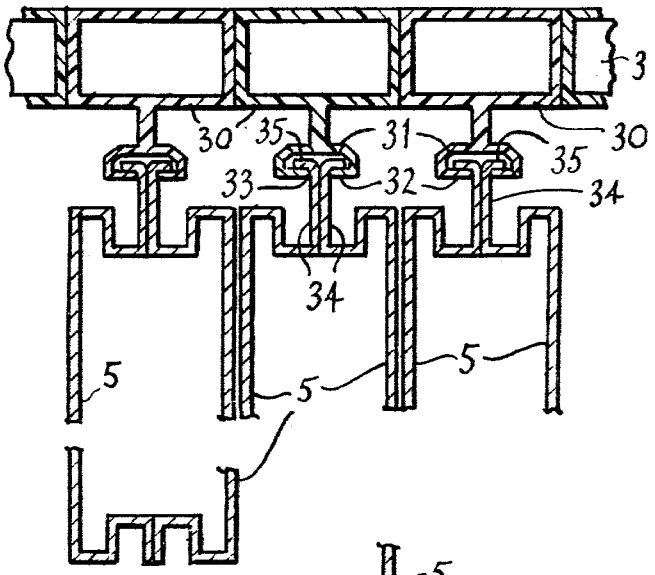
FIG. 5 is a section similar to FIG. 2 of a modified construction of panel-carrier and arrangement for attaching the panels thereto, the panels being shown suspended vertically below the panel-carriers.
Figure 6:
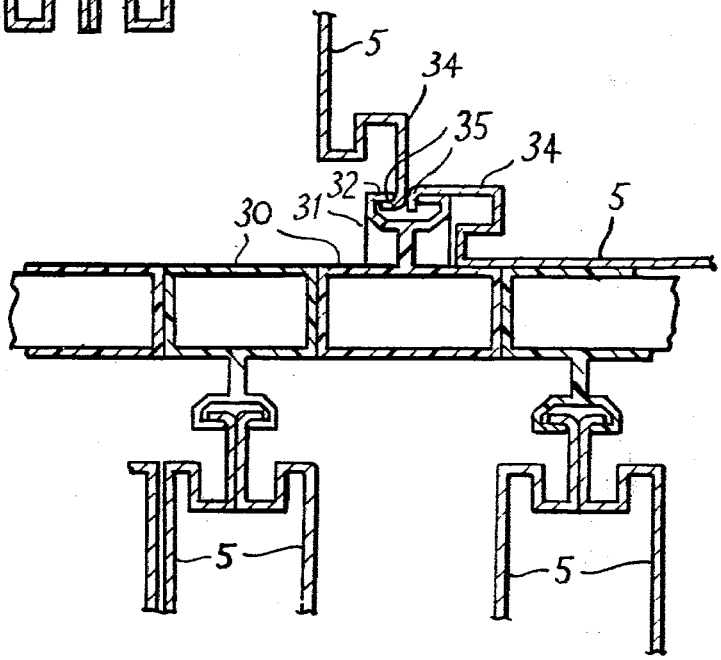
FIG. 6 is a section similar to FIG. 5 but with a panel-carrier turned through 180° and with one of the panels pivotted to its horizontal position.

FIGS. 5 and 6 show a modification in which a pair of panels 5 supported by a panel-carrier 4 are independently detachable therefrom, the arrangement being such that even if one panel is detached the other panel can remain suspended and can be removed only when turned to its horizontal position.

As shown, each panel-carrier 4 is again conveniently made as a plastics extrusion with a box-like portion 30 having a depending channel portion 31 extending therealong, the free edges of the channel having opposed inwardly extending ribs 32 defining a gap 33 into which L-shaped flanges 34, 35 along the edges respectively of a pair of panels can be inserted so that the panels will be suspended vertically below the panel-carrier as shown in FIG. 5. When a panel-carrier is inverted and a panel is swung about the fulcrum 32 to its horizontal position, as shown in FIG. 6, the end portion 35 of its L-shaped flange can be removed through the gap 33 in the channel 31 and be re-attached by the reverse operation. The width of the end portion 35 is greater than the width of the gap 33 so that so long as a panel remains substantially vertical its L-shaped flange will remain hooked in the channel even though the other panel of a pair has been removed.

In order to provide support for the panel at the end of the array when it is opened to its horizontal position, the stand may be provided with an extensible support bar 7 which may be telescopically slidable in the spindle 3, which for this purpose may be tubular. Alternatively, the stand may be provided with a shelf or brackets, which may be foldable.

I claim:

1. Storage apparatus for visible index records, comprising (a) a plurality of elongate panels of generally rectangular shape and having a front face and a rear face, (b) a plurality of records, (c) each said panel including means removably assembling a plurality of said records in overlapping array on the front face of the panel, (d) a support means, (e) a plurality of elongate panel-carriers, (f) a spindle supported horizontally by said support means and supporting said panel-carriers in side-by-side relationship for independent pivotal movement about the common horizontal axis of said spindle, (g) hinge means attaching two panels to each panel-carrier, each panel being attached to the associated panel-carrier by a longer side thereof for swinging movement relative to the associated panel-carrier in a direction at right angles to the direction in which the panel-carriers pivot about said common axis, (h) said common axis being disposed approximately midway along the length of the longer sides of the panels which are attached to the panel-carrier, and (i) said hinge means being so positioned and arranged that a pair of panels attached to a panel-carrier can be swung to a closed-together position with the records assembled to the front faces of the respective panels facing each other, whereby the pairs of panels attached to the respective panel-carriers can be stored side-by-side and suspended vertically below the panel-carrier to which they are respectively attached, and when a panel-carrier is pivoted through 180° about said common horizontal axis to an inverted position, the pair of panels attached thereto can be swung apart in opposite directions to an open position in which their rear faces are supported on other panel-carriers.

2. Apparatus as claimed in claim 1, characterized in that a panel is attached to its associated panel-carrier in such a manner that it becomes detached or is detachable therefrom when it is swung to its said substantially horizontal position.

3. Apparatus as claimed in claim 2, characterised in that a pair of panels, in closed-together position, are attached to a panel-carrier by parts of each panel extending between and respectively engaging behind two abutments extending parallel to each other on the panel-carrier, said abutments serving as fulcra about which the respective panels swing at least during the initial part of the movement of a panel to its said substantially horizontal open position.

4. Apparatus as claimed in claim 3, characterised in that the panels are hinged together, independently of said fulcra, along their respective sides which are attached to the panel-carrier.

5. Apparatus as claimed in claim 4, characterised in that the hinge and fulcra associated with a pair of panels are disposed relative to each other so that the initial swinging movement of the pair of panels about the fulcra from the closed-together position to the open position involves an over-centre reaction on the hinge tending to hold the panels in their closed-together position.

6. Apparatus as claimed in claim 3, characterised in that each panel comprises an L-shaped flange, the flanges of a pair of panels extending together through a gap between said two abutments with their respective end portions engaging behind the respective abutments, the width of each end portion being greater than the width of the gap between the abutments.

7. Apparatus as claimed in claim 3, characterised in that each panel-carrier comprises a plastics extrusion having a portion of open channel section with abutments facing each other adjacent their free edges, said abutments defining said fulcra, the panel-carriers being mounted side-by-side for pivotting movement about a substantially horizontal spindle which is carried by a support and extends through apertures in said panel-carrier extrusions approximately mid-way along their lengths, stop means carried by said support, and stops on said panel-carriers and cooperating with said stop means to limit the inverted position of the panel-carriers.

8. Apparatus as claimed in claim 1, characterised by a pair of panels which are hingedly and detachably connected together by means of a strip-like connector having bulbous enlargements along each edge which are respectively retained in undercut grooves or concave channels which are open along their length.

9. Storage apparatus according to claim 1, wherein each panel-carrier includes stop means resisting pivotting of a panel-carrier in one direction when positioned with its associated panels suspended therebelow and in the opposite direction when said panel-carrier has been pivoted through 180° to its inverted position.

* * * * *